US007823731B2

(12) United States Patent
Wu

(10) Patent No.: US 7,823,731 B2
(45) Date of Patent: Nov. 2, 2010

(54) CIGARETTE PACKAGE

(75) Inventor: Xuan Fei Wu, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 886 days.

(21) Appl. No.: 11/116,136

(22) Filed: Apr. 27, 2005

(65) Prior Publication Data

US 2006/0243611 A1 Nov. 2, 2006

(51) Int. Cl.

| | |
|---|---|
| ***B65D 79/00*** | (2006.01) |
| ***B65D 85/10*** | (2006.01) |
| ***B65D 69/00*** | (2006.01) |
| ***B65D 71/00*** | (2006.01) |
| ***A24F 15/00*** | (2006.01) |
| ***B65H 15/00*** | (2006.01) |

(52) U.S. Cl. ..... 206/754; 206/250; 206/236; 221/229

(58) Field of Classification Search ..... 206/236, 206/242, 249, 250, 252, 254, 255, 267, 37, 206/85, 443, 751, 754, 755–759, 768, 804, 206/39.4; 221/228, 229, 246, 263, 15, 88; 40/488, 491; 446/310; 220/810–813
See application file for complete search history.

(56) References Cited

U.S. PATENT DOCUMENTS

| | | | | |
|---|---|---|---|---|
| 1,029,096 | A * | 6/1912 | Wolf | 206/749 |
| 1,186,624 | A * | 6/1916 | Vanderveer | 206/249 |
| 1,937,222 | A * | 11/1933 | Gallahan | 206/254 |
| 2,185,604 | A | 1/1940 | Moore | |
| 2,755,921 | A * | 7/1956 | Ortendahl | 206/755 |
| 3,155,275 | A | 11/1964 | Slattery et al. | |
| 3,272,321 | A | 9/1966 | Tamarin | |
| 3,282,465 | A | 11/1966 | Davis | |
| 3,353,657 | A * | 11/1967 | Young | 206/755 |
| 3,765,528 | A * | 10/1973 | Parisot | 206/754 |
| 4,081,126 | A | 3/1978 | Barnard | |
| 4,240,548 | A | 12/1980 | Stio | |
| 4,300,675 | A * | 11/1981 | Wagner | 206/252 |
| 4,493,417 | A * | 1/1985 | Ackeret | 206/387.13 |
| 4,669,611 | A | 6/1987 | Flaherty | |
| 5,265,717 | A | 11/1993 | Daghestani | |
| 5,435,439 | A | 7/1995 | Swart | |

(Continued)

FOREIGN PATENT DOCUMENTS

| | | |
|---|---|---|
| WO | 9935056 A1 | 7/1999 |

(Continued)

*Primary Examiner*—Mickey Yu
*Assistant Examiner*—Melissa L Lalli
(74) *Attorney, Agent, or Firm*—Kilpatrick Stockton LLP

(57) ABSTRACT

A cigarette package, in some embodiments, can comprise a tray, a cover coupled to the tray, and a cigarette holder secured to the tray and adapted to move between a first position substantially inside the tray and a second position substantially outside the tray. In some embodiments, a cigarette package can comprise a tray, a cover adapted to slide on the tray between a closed position and an open position, and a cigarette holder coupled to a first wall of the tray and adapted to move between a first position and a second position as the cover slides on the tray. In some embodiments, a consumer can operate a cigarette package of the present application with one hand to dispense at least one cigarette.

36 Claims, 14 Drawing Sheets

U.S. PATENT DOCUMENTS 5,533,625 A * 7/1996 Mikkelsen ..... 206/565
5,682,986 A 11/1997 Cobler
5,711,423 A * 1/1998 Fuller, Jr. ..... 206/246
5,996,784 A 12/1999 Thoeren et al.
6,157,306 A * 12/2000 Mularoni ..... 340/602
6,283,291 B1 * 9/2001 Vasudeva et al. ..... 206/373
6,547,074 B1 * 4/2003 Chen ..... 206/379
6,672,471 B2 1/2004 Cross
6,736,261 B1 5/2004 Thomas et al.
6,892,877 B2 5/2005 Shurman
RE38,905 E * 12/2005 Wei ..... 206/373
2005/0150786 A1 7/2005 Mitten et al.

FOREIGN PATENT DOCUMENTS

WO 2006017978 A1 2/2006

* cited by examiner

CIGARETTE PACKAGE

FIELD OF THE INVENTION

The present invention generally relates to packages for smoking articles and methods of dispensing smoking articles from a package. Embodiments of packages and methods of the present invention are particularly useful for dispensing smoking articles such as cigarettes.

BACKGROUND

Smoking articles, such as cigarettes, are conventionally sold in packages. Typically, each package contains about twenty cigarettes. One type of popular cigarette package is the so-called "hard pack," "crush proof box," or "hinged lid package." Such a package has generally a cuboid-type shape, is manufactured from resilient paperboard, and includes outer wrap of transparent polypropylene film. Hinged lid cigarette packs are conventionally made from two paperboard blanks. One blank forms the body and lid of the package. The second blank forms an insert or inner frame which is assembled to the inside of the front of the package. The inner frame projects above the front and side walls of the package body and provides a seal between the lid and body when the package is closed.

Another type of popular cigarette package is the so-called "soft pack." Soft packs are generally constructed of a paper materials less rigid than those used in hard packs and include an outer wrap of polypropylene film.

A common feature of both hard packs and soft packs is that access to several or all of the cigarettes in the package is provided through the top of the package. In the case of hard packs, a flip-top lid opens providing access to the cigarettes while in soft packs, a portion of the top of the package is torn away to provide access to the cigarettes. In these packaging arrangements, individual cigarettes must be selected, manually separated, and withdrawn from the package by a consumer's fingers. Typically, selecting a single cigarette for withdrawal and delivering the cigarette to the mouth of a consumer requires both hands of the consumer, which may be inconvenient in some situations. The pack may be impacted to cause one or a few cigarettes to extend from the top of the pack for grasping. In such circumstances, cigarettes adjacent to the one being removed may be ejected and lost from the package causing consumer aggravation. Moreover, some consumers may find it undesirable to handle cigarettes with unclean hands.

SUMMARY OF THE INVENTION

The present invention provides cigarette packages and methods that can provide various advantages associated with the way in which cigarettes are removed from a cigarette package. Embodiments of the present invention can provide solutions to problems associated with dispensing cigarettes in a number of ways, including, without limitation, by providing a package with a cigarette holder secured to a tray and adapted to move between a first position substantially inside the tray and a second position substantially outside the tray.

In some embodiments, a cigarette package of the present invention comprises a tray, a cover coupled to the tray, and a cigarette holder secured to the tray and adapted to move between a first position substantially inside the tray and a second position substantially outside the tray. In some embodiments, the tray may comprise a back wall and four side walls and may be generally square and/or rectangular in shape and may be constructed of metal and/or plastic.

In some embodiments, the cigarette holder may be hingedly secured to a first wall of the tray. In some embodiments, the cigarette holder may rotate from the first position substantially inside the tray to the second position substantially outside the tray. In some embodiments, the cigarette holder may be operable to rotate at least about 30 degrees from the first position. In other embodiments, the cigarette holder may be operable to rotate up to about 45 degrees from the first position. In further embodiments, the cigarette holder may be operable to rotate between about 30 and about 45 degrees from the first position. In some embodiments, the cigarette holder may be operable to dispense at least one cigarette. In some embodiments, the cigarette holder may be operable to hold two or less cigarettes.

The cover coupled to the tray, in some embodiments, may be operable to move between a closed position and an open position. In some embodiments, the cover may be slidably coupled to the tray, such that the cover slides between a closed position and an open position. In some embodiments where the cover is slidably coupled to the tray, the cover may comprise a raised stop, which can prevent the cover from sliding off the tray. In other embodiments, the tray may comprise at least one stop operable to prevent the cover from sliding off the tray.

In some embodiments, the cover may comprise window. The window can be constructed of a transparent or translucent material. In some embodiments, the window may allow a consumer to view the cigarette holder disposed in the tray. In other embodiments, the window may allow a consumer to view the entire contents of the tray including the cigarette holder. In some embodiments, the cover may comprise a tractive region comprising a tractive material or design. The tractive region can facilitate moving the cover between the open and closed positions. The tractive region, for example, can facilitate a consumer's ability to slide the cover between the open and closed positions.

In some embodiments, the cigarette holder moves between the first position substantially inside the tray and the second position substantially outside the tray as the cover moves from the closed position to the open position. In some embodiments, the cigarette holder may be coupled to the cover. In some embodiments, the cigarette holder may be coupled to the cover by a twist shaft.

In some embodiments wherein the cigarette holder may be coupled to the cover by a twist shaft, rotation of the twist shaft may move the cigarette holder from the first position substantially inside the tray to the second position substantially outside the tray. In some embodiments, the cigarette holder can move on a pin which may secure the cigarette holder to a wall of the tray thereby allowing gravity to move the cigarette holder from the first position to the second position. In some embodiments, the cigarette holder may move from the first position to the second position by any means known to one of skill in the art.

In some embodiments, the cigarette holder may rotate from the first position to the second position as the cover moves from the closed position to the open position. The cigarette holder, in some embodiments, may rotate at least about 30 degrees from the first position substantially inside the tray as the cover moves from the closed position to the open position. In other embodiments, the cigarette holder may rotate up to about 45 degrees from the first position as the cover moves from a closed position to an open position. In other embodiments, the cigarette holder may rotate about 30 degrees to about 45 degrees from the first position as the cover moves from a closed position to an open position.

In some embodiments where the cover is slidably coupled to the tray, the cigarette holder may move from the first position substantially inside the tray to the second position substantially outside the tray as the cover slides from the open position to the closed position. The cigarette holder may be coupled to the sliding cover in some embodiments. The cigarette holder, in some embodiments, may rotate from the first position to the second position as the cover slides from the closed position to the open position.

In some embodiments of the present invention, movement and/or rotation of the cigarette holder from the first position to the second position in concert with movement and/or sliding of the cover from the closed position to the open position may be reversible. The cigarette holder, for example, may move and/or rotate from the second position substantially outside the tray to the first position substantially inside the tray as the cover moves and/or slides from the open position to the closed position.

In some embodiments, the cigarette package may comprise a plurality of cigarettes disposed in the tray. The plurality of cigarettes may be disposed in the tray in at least one row. In other embodiments, the plurality of cigarettes may be disposed in the tray in a plurality of rows. The plurality of cigarettes, for example, may be disposed in the tray in two or more rows. Moreover, the plurality of cigarettes, in some embodiments, may comprise at least ten cigarettes. In other embodiments, the plurality of cigarettes may comprise twenty cigarettes. In some embodiments, at least one of the plurality of cigarettes is disposed in the cigarette holder.

The cigarette package, in some embodiments, may further comprise a raised plate disposed in the tray adjacent to the cigarette holder. The raised plate may support cigarettes disposed in the tray. In some embodiments, the raised plate may be disposed in the tray such that the plate lies in a plane above the base of the cigarette holder. Such an arrangement can allow cigarettes supported by the raised plate to fall into the cigarette holder for subsequent dispensing.

In some embodiments, a cigarette package may further comprise a cigarette blocking element secured to a second wall of the tray, wherein the second wall is in facing opposition to the first wall to which the cigarette holder may be secured. The cigarette blocking element can comprise, for example, paper, plastic wrap, metal foil, or combinations thereof. The cigarette blocking element can be operable to prevent cigarettes not disposed in the cigarette holder from falling out of the tray when the cigarette package is opened.

Cigarette packages, in some embodiments, may further comprise a cigarette holder blocking element. In some embodiments where the tray of the cigarette package comprises more than one row of cigarettes, a cigarette holder blocking element may be disposed in the tray so as to prevent cigarettes located in rows behind a first row from entering the cigarette holder. In such embodiments, cigarettes may be sequentially fed into the cigarette holder from the first row of cigarettes. As cigarettes are dispensed from the cigarette package, cigarettes located in rows behind the first row may advance to the first row for dispensing.

In some embodiments, the cigarette package may be reloaded with at least one cigarette. In some embodiments, the cigarette holder may be reloaded with a plurality of cigarettes. In a some embodiments, the cigarette package may be reusable.

Embodiments of the present invention also relate to methods for dispensing cigarettes. In some embodiments, a method for dispensing cigarettes from a cigarette package can comprise providing a cigarette package comprising a tray, a cover slidably coupled to the tray, a cigarette holder, at least one cigarette positioned in the holder, wherein the cigarette holder is adapted to move between a first position substantially inside the tray and a second position substantially outside the tray as the cover slides; and sliding the cover from a closed position to an open position so as to move the cigarette holder from the first position to the second position.

In some embodiments, the cigarette holder may rotate from the first position to the second position. The cigarette holder and the at least one cigarette held therein, in some embodiments, may rotate at least about 30 degrees from the first position. In some embodiments, the cigarette holder and at least one cigarette held therein may rotate up to about 45 degrees from the first position. In some embodiments, the cigarette holder and at least one cigarette held therein may rotate from about 30 degrees to about 45 degrees from the first position.

Methods for dispensing cigarettes, in some embodiments, may further comprise removing at least one cigarette from the cigarette holder and sliding the cover from the open position to the closed position so as to move the cigarette holder from the second position substantially outside the tray to the first position substantially inside the tray. In some embodiments, a second cigarette may be positioned in the cigarette holder such that the method may be repeated.

These and other embodiments of the present invention are described in greater detail in the detailed description of the invention which follows.

DETAILED DESCRIPTION OF THE INVENTION

The present invention relates to packages for smoking articles and methods of dispensing smoking articles from a package. The packages and methods are particularly useful for dispensing smoking articles such as cigarettes.

In some embodiments, a cigarette package may facilitate removal of cigarettes from the package through the use of a cigarette holder. In some embodiments, the cigarette holder can dispense at least one cigarette by moving from a first position substantially inside a tray of the cigarette package to a second position substantially outside the tray. Movement of the cigarette holder and at least one cigarette disposed therein to a second position substantially outside the tray of the cigarette package may place the at least one cigarette in an advantageous position for grasping by a consumer's hand or mouth. The cigarette holder, for example, can remove at least one cigarette from a plurality of cigarettes disposed in a tray of the cigarette package enabling a consumer to easily grasp the at least one cigarette without touching or accidentally removing additional cigarettes from the cigarette package.

In some embodiments, the cigarette holder and at least one cigarette disposed therein may move from a first position substantially inside the tray to a second position substantially outside the tray as the cover of the cigarette package moves from a closed position to an open position. In such embodiments, a consumer may use one hand to obtain at least one cigarette from the cigarette package by sliding the cover with one hand and grasping the cigarette with his or her mouth.

Figure 1:
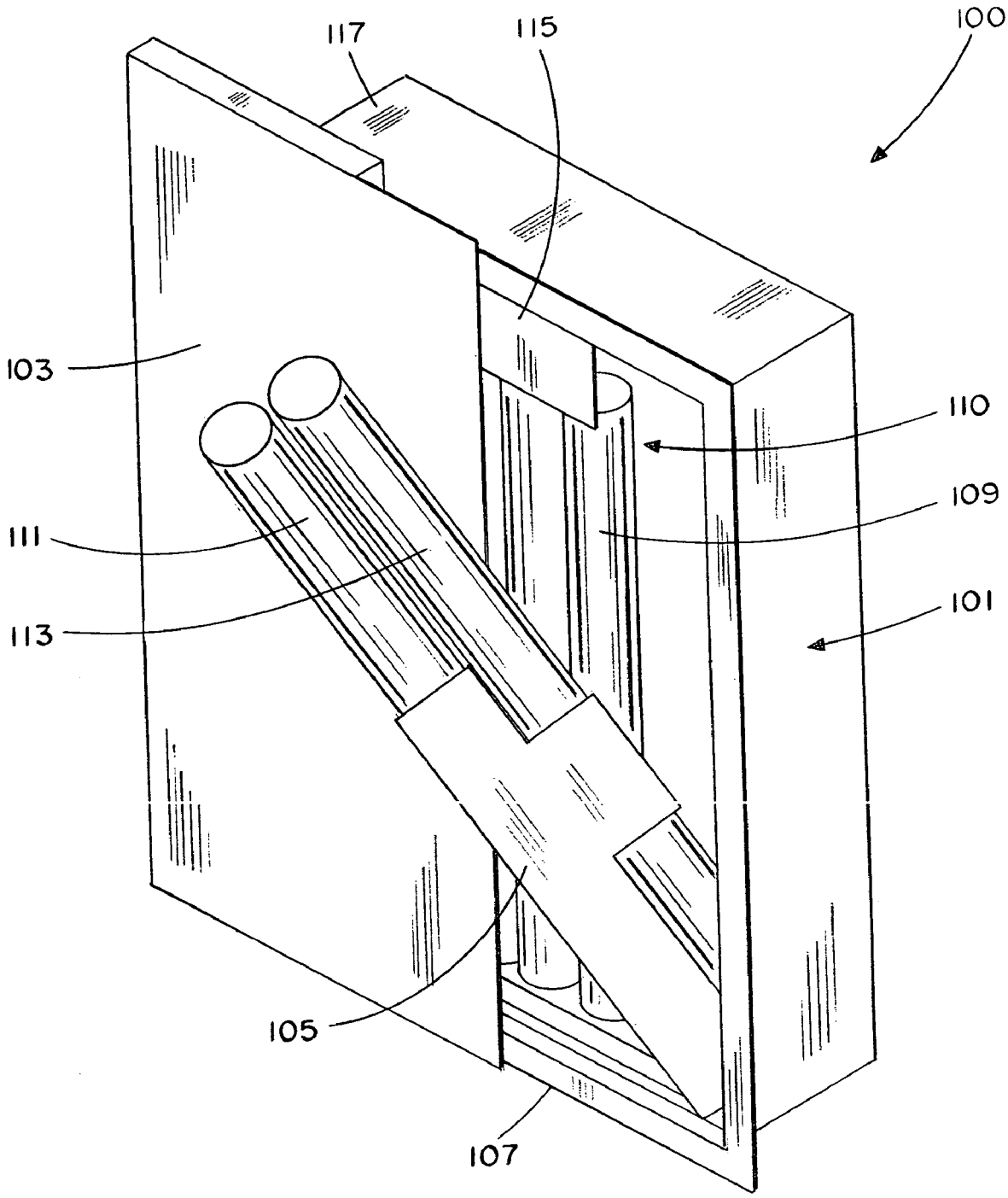
FIG. 1 is a perspective view of a cigarette package according to one embodiment of the present invention.
Figure 2:
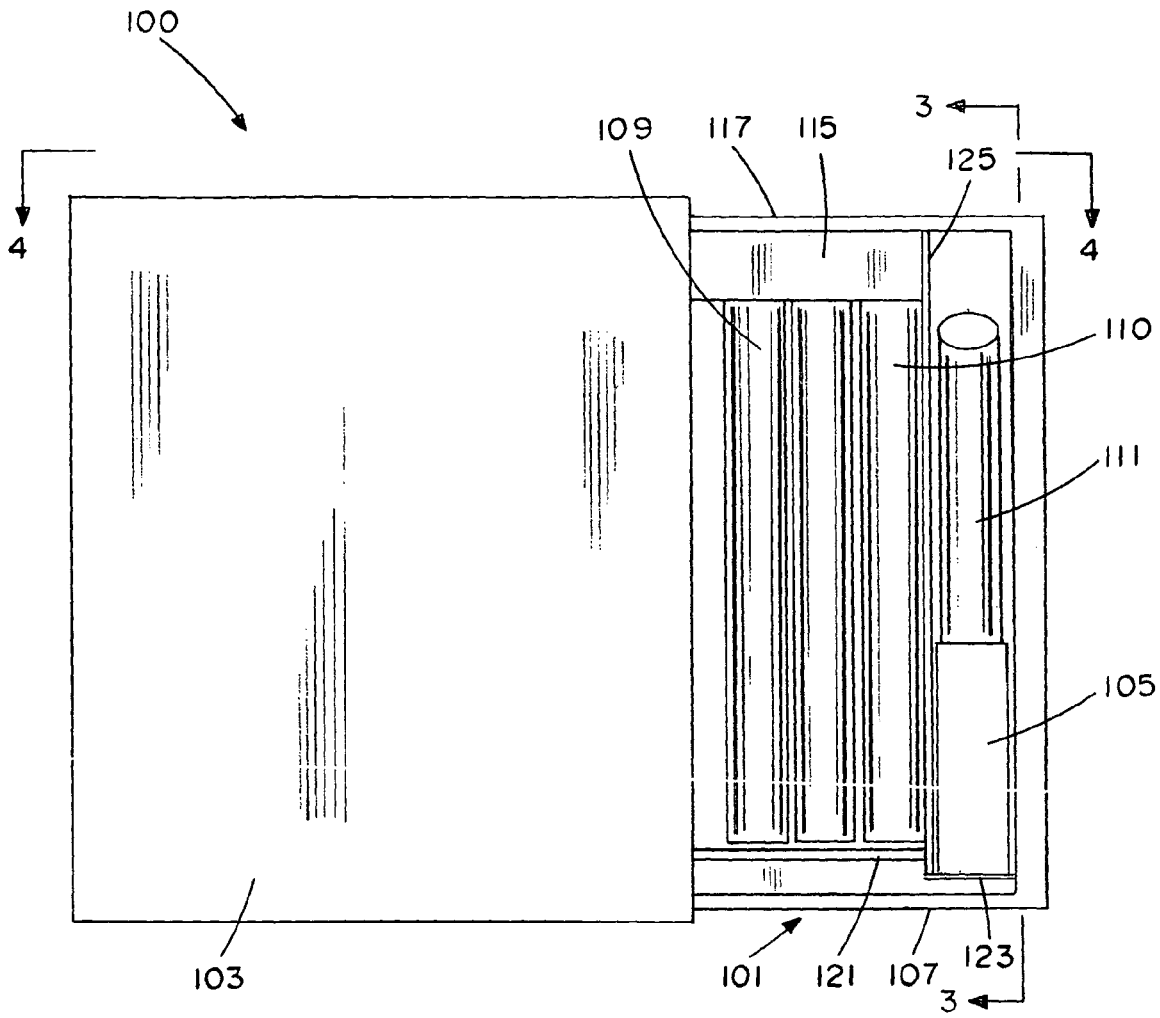
FIG. 2 is a top plan view of a cigarette package according to one embodiment of the present invention.
Figure 3:
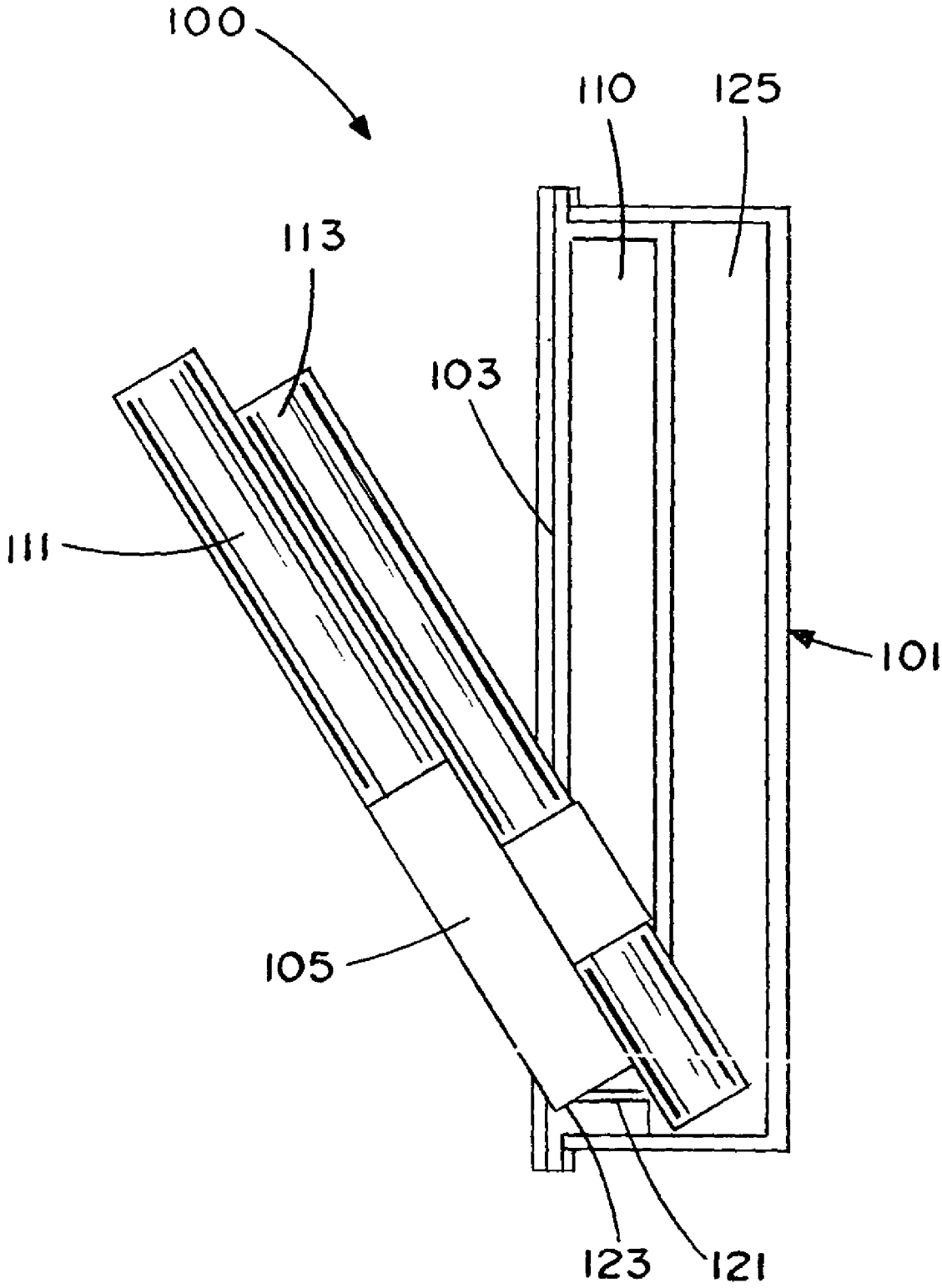
FIG. 3 is a cross-sectional view of a cigarette package according to one embodiment of the present invention taken along the 3-3 line in FIG. 2.
Figure 4:
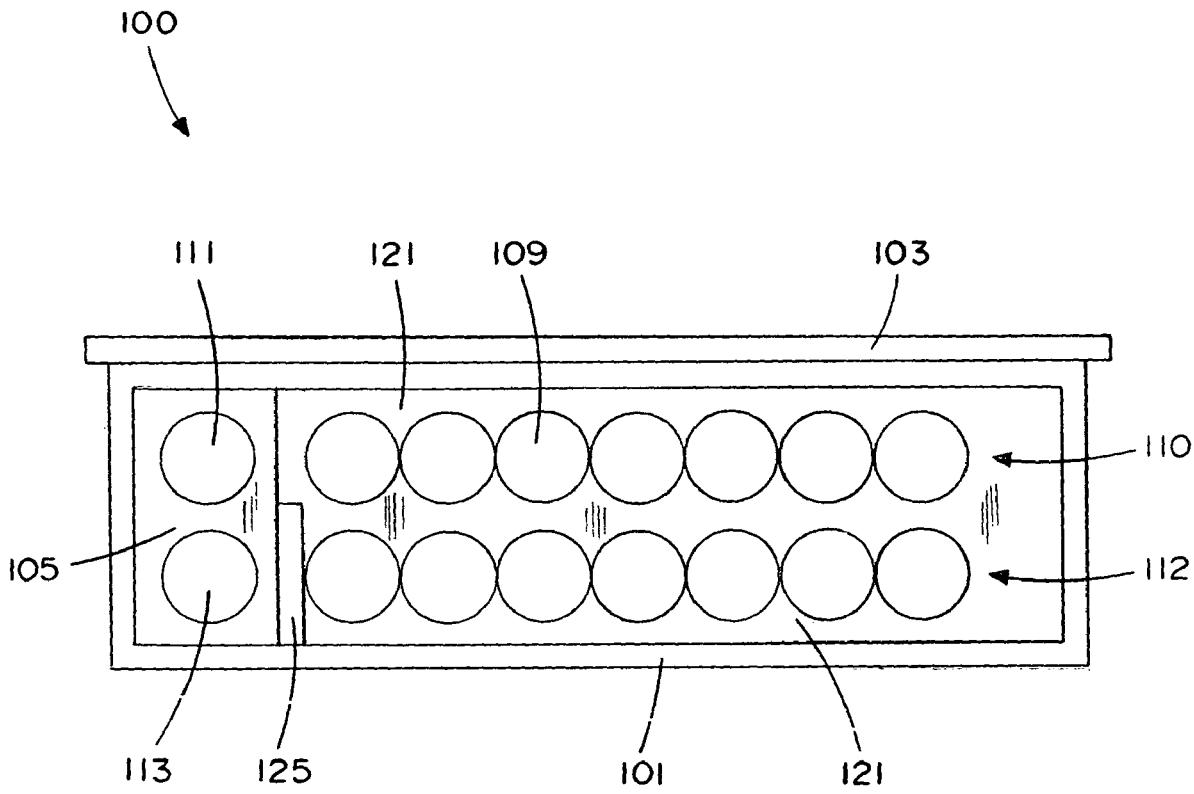
FIG. 4 is an cross-sectional view of a cigarette package according to one embodiment of the present invention taken along the 4-4 line of FIG. 2.
Figure 5:
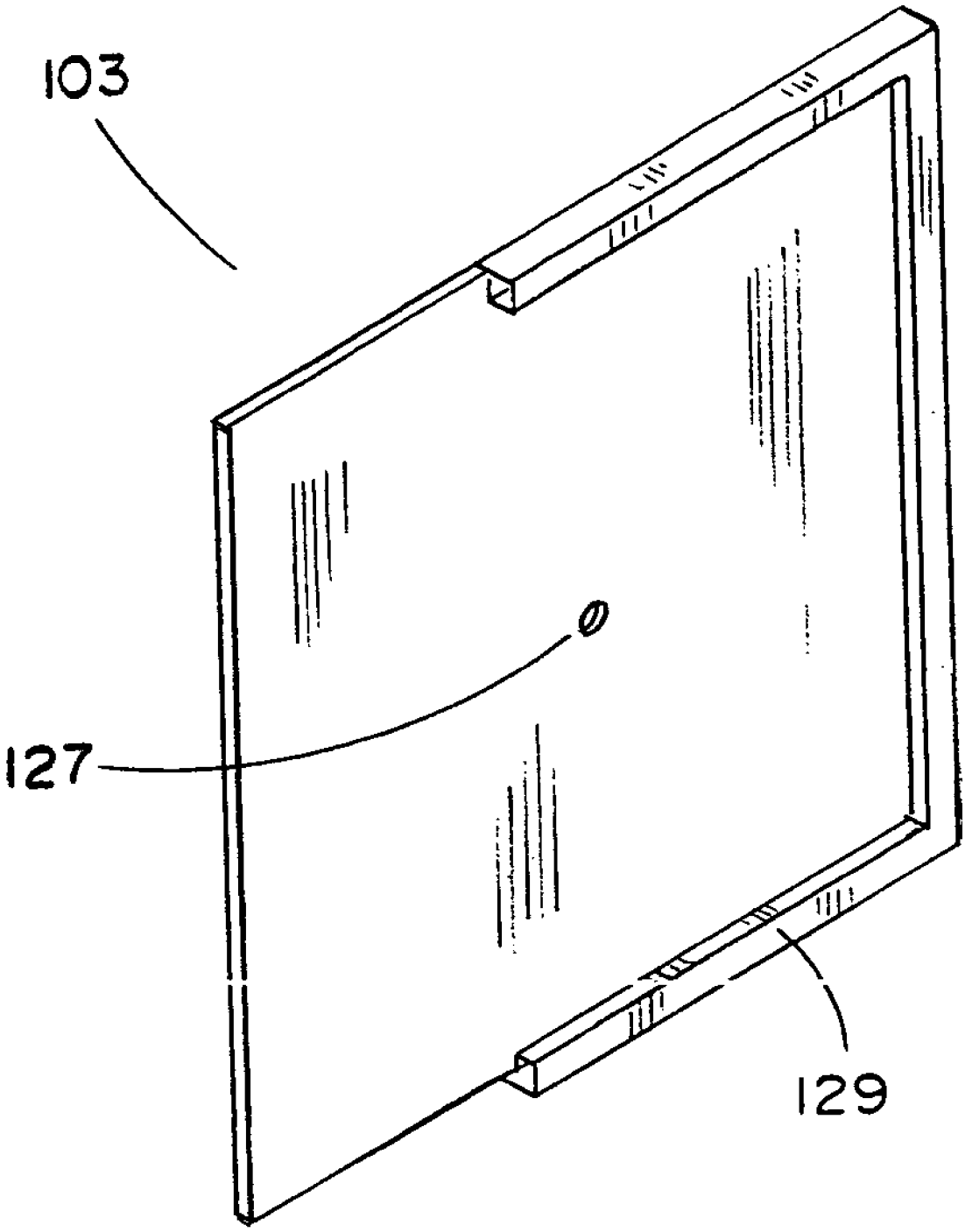
FIG. 5 is a perspective view of a cover of a cigarette package according to one embodiment of the present invention.
Figure 6:
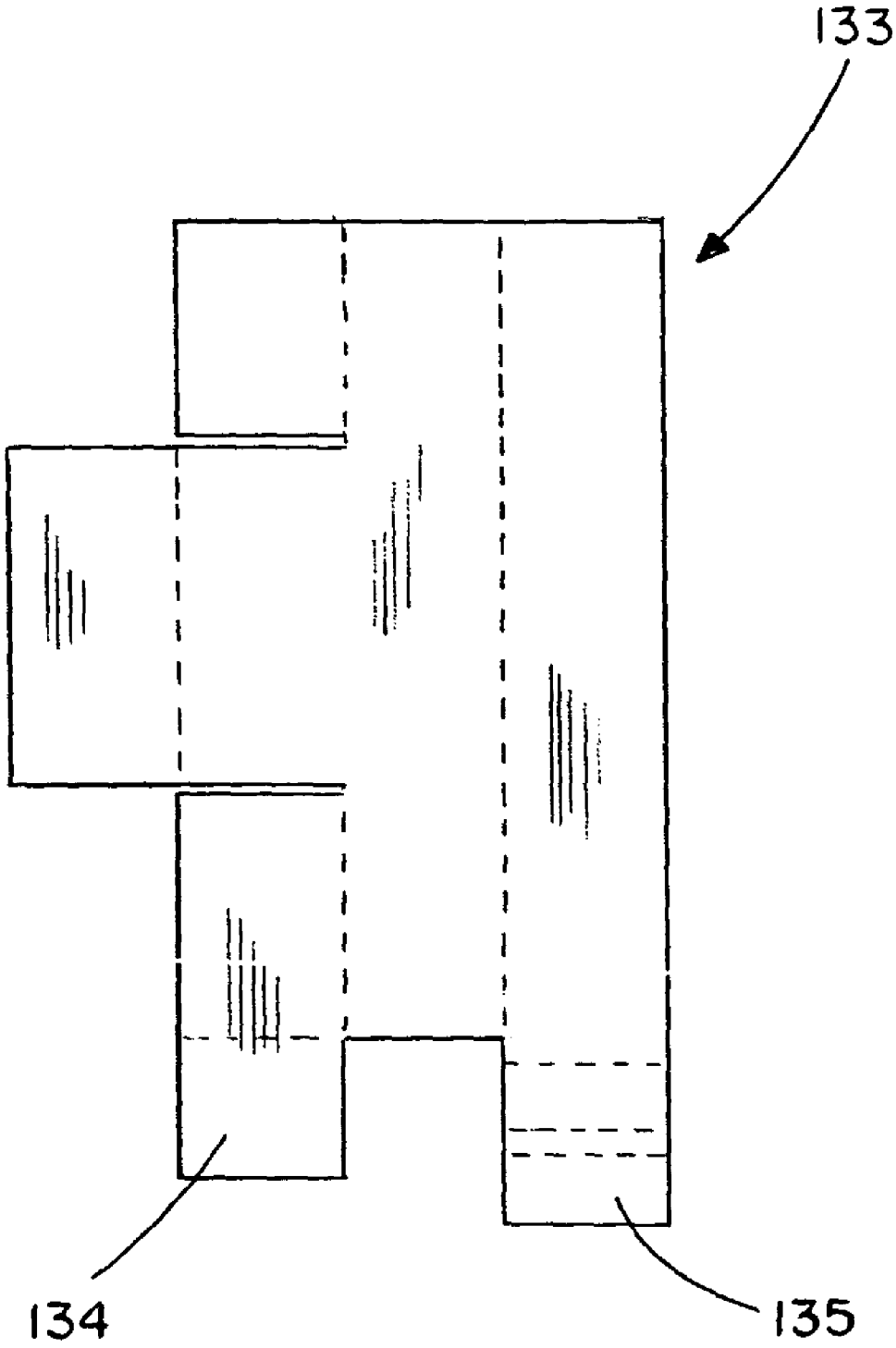
FIG. 6 illustrates an example of a blank that can be used to form a cigarette holder for a cigarette package according to one embodiment of the present invention.

Referring now to the Figures in which like numerals refer to like elements throughout the drawings, FIGS. 1-6 illustrate a cigarette package according to one embodiment of the present invention. FIG. 1 illustrates a perspective view of the cigarette package while FIG. 2 is a top plan view of the cigarette package. FIGS. 3 and 4 are cross-sectional views of the cigarette package. FIG. 5 is a perspective view of a cover of the cigarette package, and FIG. 6 illustrates a blank used to form a cigarette holder of the cigarette package. Moreover, several figures provide views of cigarette packages according to some embodiments of the present invention comprising a plurality of cigarettes. It should be noted that the plurality of cigarettes are included in these views to aid the understanding of the invention. Although it is contemplated that cigarette packages of the present invention may comprise one cigarette or a plurality of cigarettes, it is not contemplated that the cigarette packages of the present invention be limited to embodiments comprising one cigarette or a plurality of cigarettes.

Referring now to FIG. 1, the embodiment of the cigarette package 100 illustrated in FIG. 1 comprises a tray 101, a cover 103 adapted to be secured to the tray 101, and a cigarette holder 105 secured to a first wall 107 of the tray 101. The cigarette holder 105 may be hingedly secured to a first wall 107 of the tray 101 allowing the cigarette holder 105 to move from a first position substantially inside the tray 101 to a second position substantially outside the tray 101. The cover 103 of the cigarette package in the embodiment illustrated in FIG. 1 is slidably coupled to the tray 101 and is shown in the open position. The cover 103 is operable to slidably return to the closed position. The cigarette holder 105 is displayed in the second position substantially outside the tray 101.

A plurality of cigarettes 109 are disposed in the tray 101 with at least one 111 of the plurality of cigarettes 109 disposed in the cigarette holder 105. The plurality of cigarettes 109 are shown in a first row 110. The cigarette holder 105 may be operable to hold two or less cigarettes in some embodiments. The cigarette holder 105 in the embodiment illustrated in FIG. 1 is shown holding two cigarettes 111, 113. In some embodiments, the cigarette holder 105 may be adapted to hold one cigarette. The first cigarette 111 is shown as extending further out of the cigarette holder 105 than the second cigarette 113 such that a consumer may differentiate between the two cigarettes 111, 113 in the cigarette holder 105. In some embodiments, a first cigarette may extend further out of a cigarette holder than a second cigarette by greater than about 5 mm. In other embodiments, a first cigarette may extend up to about 10 mm further out of a cigarette holder than a second cigarette. In some embodiments wherein a cigarette holder can hold two cigarettes, a first cigarette may not extend further out of the cigarette holder than a second cigarette.

FIG. 1 additionally displays a cigarette blocking element 115 secured to a second wall 117 of the tray 101, wherein the second wall 117 is in facing opposition to the first wall 107. The cigarette blocking element 115, in some embodiments, is operable to prevent the plurality of cigarettes 109 from falling out of the tray 101 when the cover 103 of the cigarette package 100 is in the open position. Cigarette blocking elements can comprise paper, metal foil, a plastic wrap or other polymeric material, and/or combinations thereof, or other materials typically used in constructing cigarette packages or components thereof.

FIG. 2 is a top plan view of the cigarette package 100 wherein the cover 103 is in the open position, and the cigarette holder 105 is displayed in a position substantially outside the tray 101. A plurality of cigarettes 109 are disposed in the tray 101 in a first row 110, wherein a portion of each of the plurality of cigarettes 109 is placed under the cigarette blocking element 115. The embodiment of the cigarette package 100 illustrated in FIG. 2 further comprises a raised plate 121 disposed in the tray 101 adjacent to the cigarette holder. The raised plate 121 may be secured to a first wall 107 of the tray 101 or the raised plate 121 may be a continuous part of the tray 101 formed in the initial construction of the tray 101. The raised plate 121 is operable to support the plurality of cigarettes 109 disposed in the tray 101. As shown in FIG. 2, the raised plate 121 is disposed in the tray 101 on a plane higher than the base 123 of the cigarette holder 105. This arrangement can assist cigarettes 109 disposed in the tray 101 in falling into the cigarette holder 105 for subsequent dispensing.

The cigarette package 100 illustrated in FIG. 2 further comprises a cigarette holder blocking element 125 disposed in the tray adjacent to the cigarette holder 105. The cigarette holder blocking element 125 may be secured to the back wall (not shown) of the tray 101. The cigarette holder blocking element can comprise paper, metal, metal foil, plastic, and/or combinations thereof, or other materials known to be useful in constructing cigarette packages or components thereof. Alternatively, a cigarette blocking element can be a continuous part of the tray formed in the initial construction of the tray. In embodiments where a plurality of cigarettes are disposed in the a tray in a series of two or more rows, a cigarette blocking element can be operable to prevent cigarettes located in rows other than the first row from entering the cigarette holder. For example, in the Figures shown, the cigarette holder blocking element 125 is disposed in the tray 101 to block cigarettes 109 not positioned in the first row 110 from entering the cigarette holder 105.

FIG. 3 is a cross-sectional view of the cigarette package 100 taken along the 3-3 line of FIG. 2. As in FIG. 1, the cover 103 of the cigarette package 100 is in an open position, and the cigarette holder 105 is shown in a position substantially outside the tray 101. In some embodiments, the cigarette holder 105 in this position may be between about 30 degrees and about 45 degrees out of plane with the cover 103 and tray 101 of the cigarette package 100. In some embodiments, a cigarette holder can be adapted to be out of plane with the cover and tray in other amounts. For example, in some embodiments, the cigarette holder can be adapted to be positioned a variety of degree amounts, up to about 90 degrees out of plane with the cover and tray. In selecting an amount, factors to be considered can include, for example, allowing the cigarette holder to be in a position to facilitate removal of at least one cigarette held therein and avoiding the positioning of the cigarette holder such that a cigarette can accidentally fall out of the holder.

FIG. 4 is a cross-sectional view of the cigarette package 100 taken along the 4-4 line of FIG. 2. The cover 103 of the cigarette package is in the closed position and the cigarette holder 105 is shown in a first position substantially inside the tray 101. The embodiment of the cigarette package 100 illustrated in FIG. 4 comprises a second row 112 of cigarettes 109 disposed in the tray 100 behind the first row 110 of cigarettes. Cigarettes 109 located in the second row 112 may be precluded from entering the cigarette holder 105 by the cigarette holder blocking element 125. As a result, cigarettes 109 may only enter the cigarette holder 105 from the first row 110, in this embodiment.

In some embodiments, a second cigarette 113 may be placed in the cigarette holder 105 behind the first cigarette 111 such that the cigarette holder 105 is operable to dispense two cigarettes 111, 113 when used for the first time. The second cigarette 113 may be placed in the cigarette holder 105 behind the first cigarette 111, for example, during the retail packaging process wherein the plurality of cigarettes 109 are disposed in the tray 101 of the cigarette package 100 for the first time. In some embodiments, once the second cigarette 113 has been dispensed, the cigarette holder 105 may only dispense a single cigarette 109 from the first row 110 as multiple cigarettes are prevented from entering the cigarette holder 105 by a cigarette blocking element 125.

The cover 103 of the cigarette package 100 illustrated in FIG. 5 comprises a raised stop 127 operable to prevent the cover 103 from sliding off the tray 101 The raised stop 127 may come into contact with a wall of the tray 101 when the cover 103 reaches the maximum open position. The raised stop 127 may be positioned on the cover in various places depending on the desired cover 103 sliding distance (e.g. the desired opening width of the package). Other techniques can be used to prevent the cover from completely sliding off the tray in embodiments where it is desirable to prevent the cover from sliding off the tray.

The cover 103 may further comprise at least a partial rim 129 having a structure adapted to be slidingly secured to the tray 101. In the embodiment shown, the partial rim 129 displays a "J" structure adapted to secure the cover 103 to a rim of the tray 101. The "J" structure may slidably interface with a flat rim of the tray 101 or may slidably interface with an "L" shaped rim of the tray 101. In other embodiments, the cover may be adapted to be secured to the tray by other means known to one of skill in the art. In some embodiments, the at least partial rim and/or tray may comprise one or a plurality of stops operable to prevent the cover from sliding off the tray if such a feature is desirable.

FIG. 6 illustrates a blank 133 which may be folded to produce the cigarette holder 105 for the cigarette package 100. The blank 133 comprises tabs 134, 135 which may be secured to a wall of the tray 101. The tabs 134, 135 may be hingedly secured to a wall of the tray 101. The blank may be constructed of plastic sheets, paper, and/or other foldable materials typically used in constructing cigarette packages or components thereof. In some embodiments, cigarette holders can be formed in other manners. In some embodiments, a cigarette holder can be constructed from a plastic material utilizing, for example, injection molding techniques.

Operation of the cigarette package illustrated in FIGS. 1-6 will now be described. In some embodiments, when purchased, a consumer may remove any overwrapping from the cigarette package 100 and grip the cigarette package 100 in one hand. The consumer may use a finger, such as a thumb, to slide the cover 103 of the cigarette package 100 from the closed position to the open position. The finger and/or fingers used to slide the cover 103 may be on the same hand gripping the cigarette package 100 or on the hand not gripping the cigarette package 100. As the cover slides 103 from the closed position to the open position, the cigarette holder 105 and at least one cigarette 111 held therein can move from the first position substantially inside the tray 101 to the second position substantially outside the tray 101. The cigarette holder 105 can be weighted, in some embodiments, such that when the cigarette package 100 is tilted in a first direction by the consumer, gravity may cause the cigarette holder 105 to move from the first position substantially inside the tray 101 to the second position substantially outside the tray 101.

With the cigarette holder 105 in the second position, the at least one cigarette 111 can be removed from the cigarette holder 105 by the consumer. Depending on the consumer's preference, the consumer may remove the at least one cigarette 111 from the cigarette holder 105 with his mouth, thereby avoiding contaminating the cigarette 111 with unclean hands. In such a situation, the consumer can use only one hand to obtain the cigarette. The consumer can also remove a cigarette using the hand that is not grasping the package, depending on the situation and the consumer's preference.

After removing the cigarette 111 from the cigarette holder 105, the consumer may slide the cover 103 from the open position to the closed position. The cigarette package 100 may be tilted in a second direction opposite the first direction as the consumer slides the cover 103 from the open position to the closed position. Tilting the cigarette package 100 in the second direction allows gravity to move the cigarette holder 105 from the second position substantially outside the tray 101 to the first position substantially inside the tray 101.

After the empty cigarette holder 105 is returned to the first position substantially inside the tray, another cigarette 109 previously disposed in the tray 101 can move into the cigarette holder 105 for subsequent dispensing. A consumer may gently shake the cigarette package 100, in some embodiments, to effectuate movement of cigarettes 109 disposed in the tray 101 such that one of the cigarettes 109 may travel off the raised plate 121 and into the cigarette holder 105.

Figure 13:
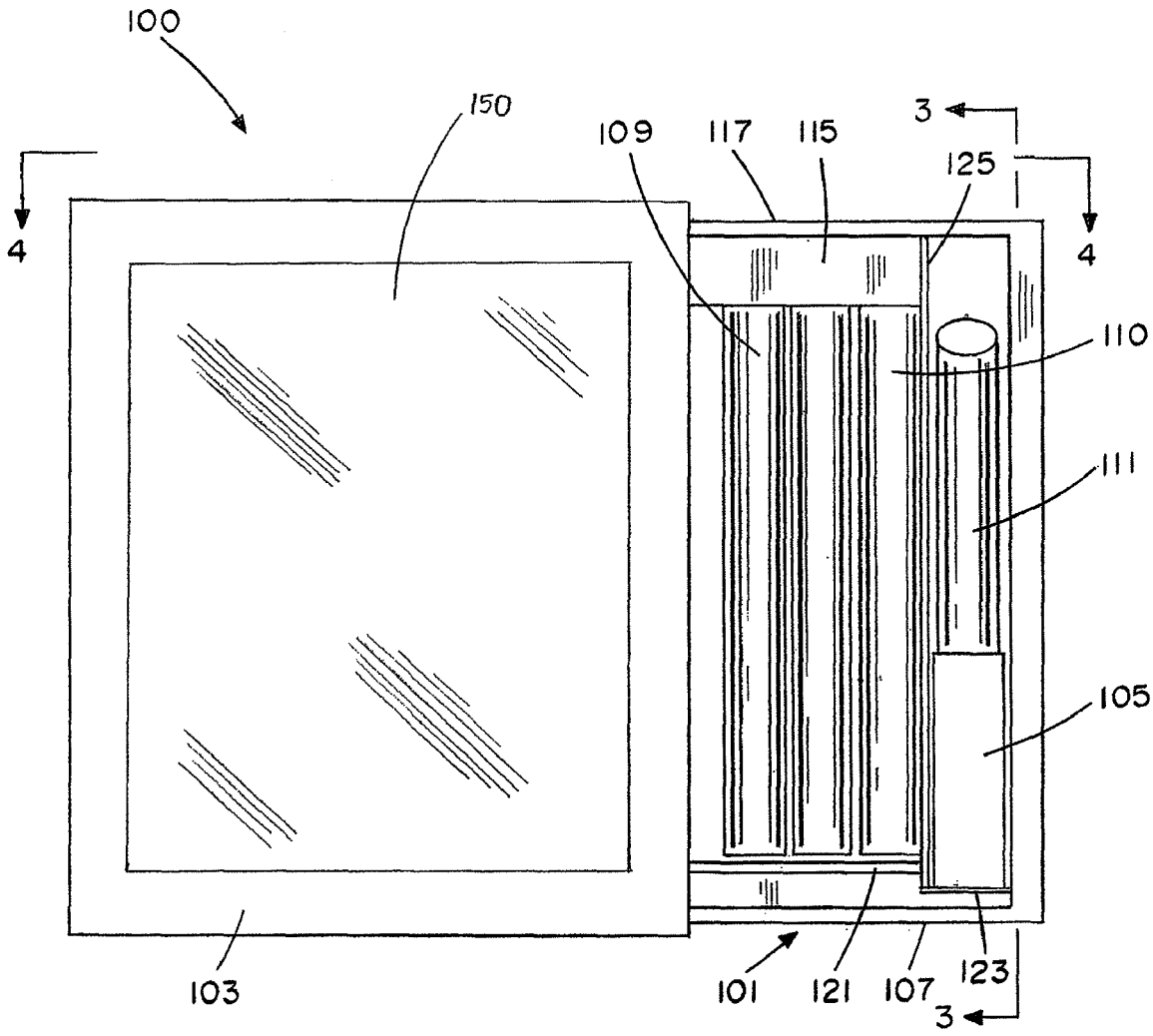
FIG. 13 is a top plan view of a cigarette package according to one embodiment of the present invention.

In some embodiments, a cover can comprise a window located above a cigarette holder allowing a consumer to determine whether a cigarette is in the cigarette holder for dispensing before sliding the cover to the open position. FIG. 13 illustrates a cover 103 comprising a window 150. When the cover 103 is in the closed position, the window 150 can be at least partially positioned above the cigarette holder 105.

Figure 7:
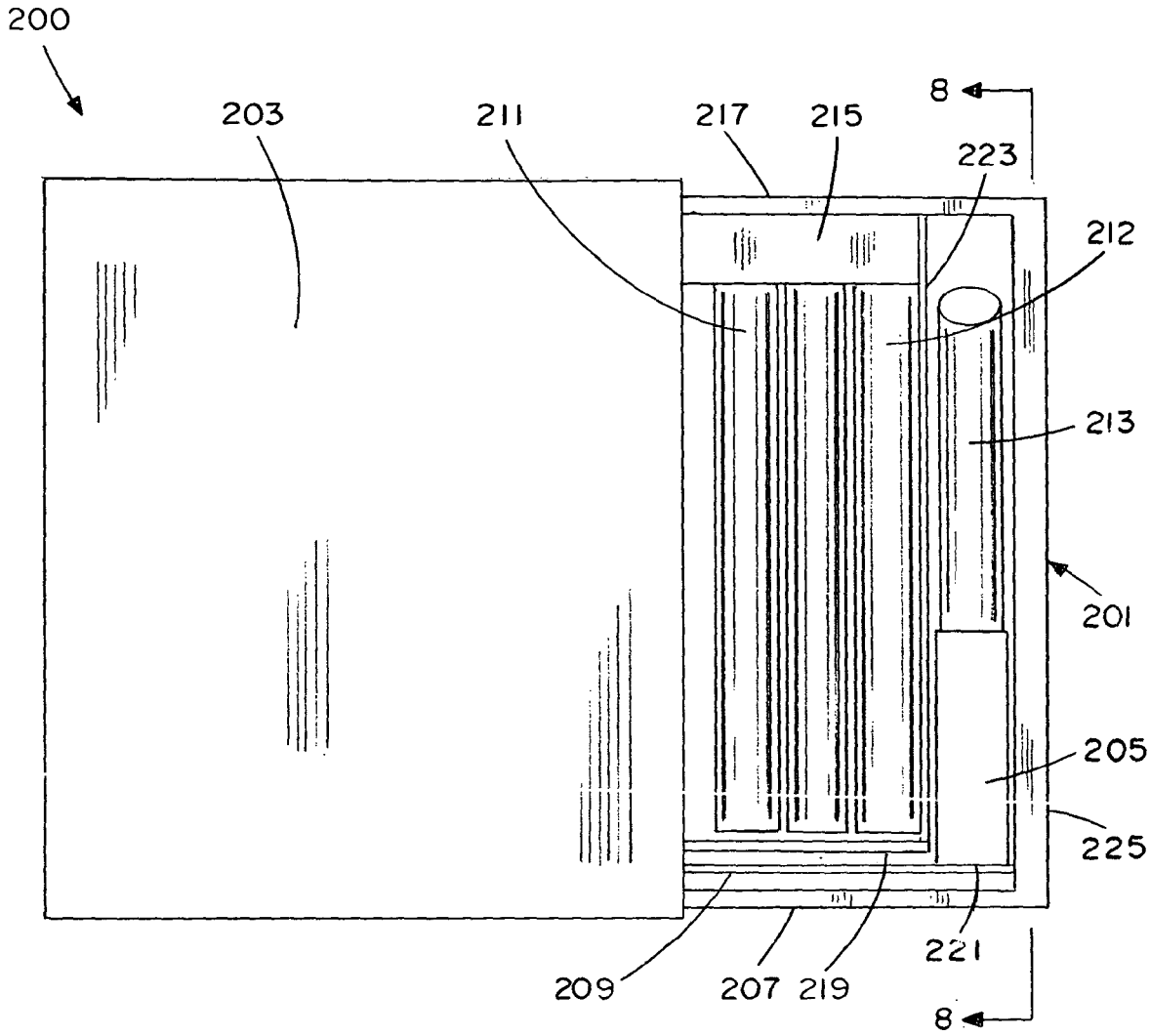
FIG. 7 is a top plan view of a cigarette package according to one embodiment of the present invention.
Figure 8:
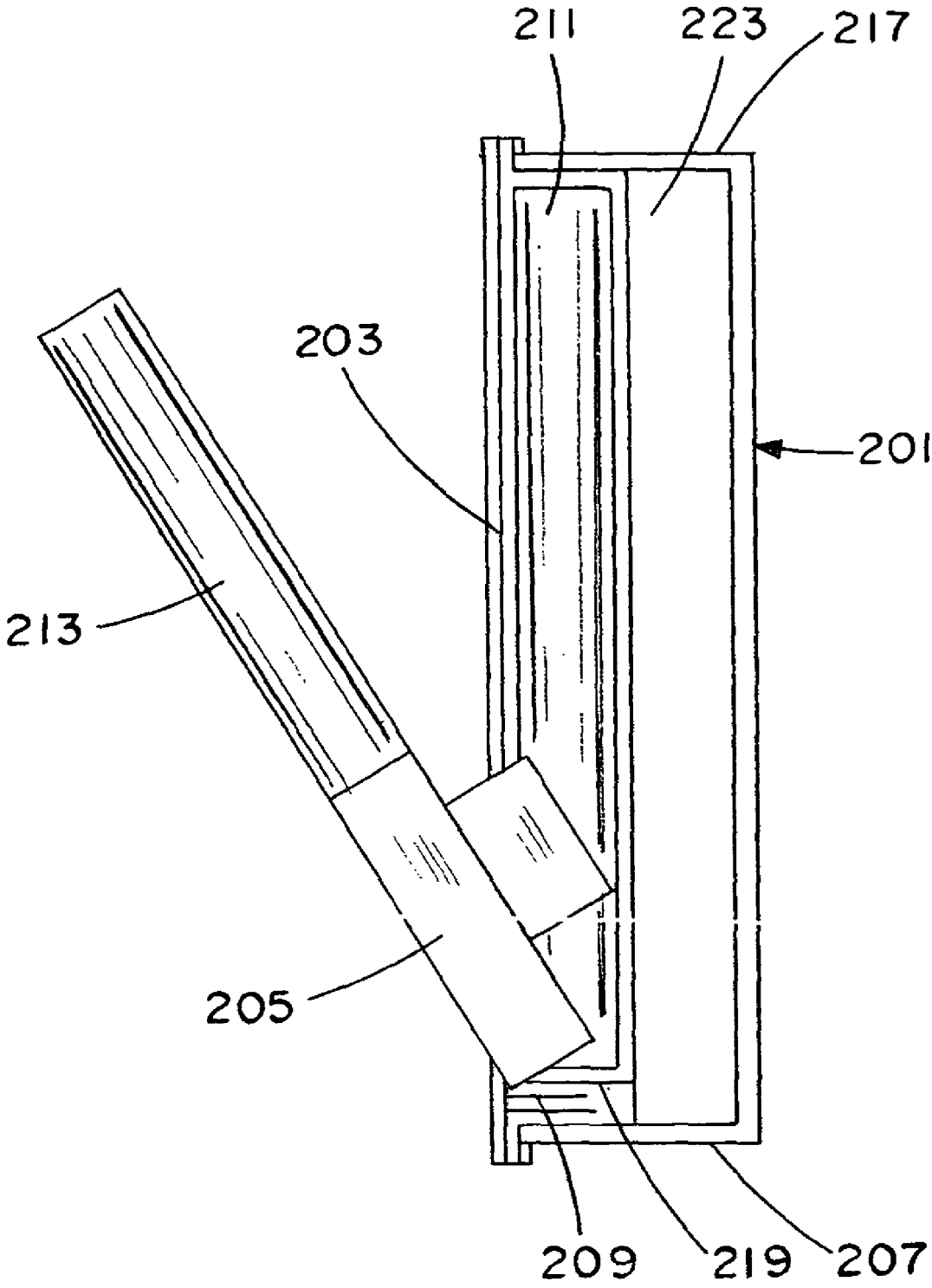
FIG. 8 is an cross-sectional view of a cigarette package according to one embodiment of the present invention taken along the 8-8 line of FIG. 7.
Figure 9:
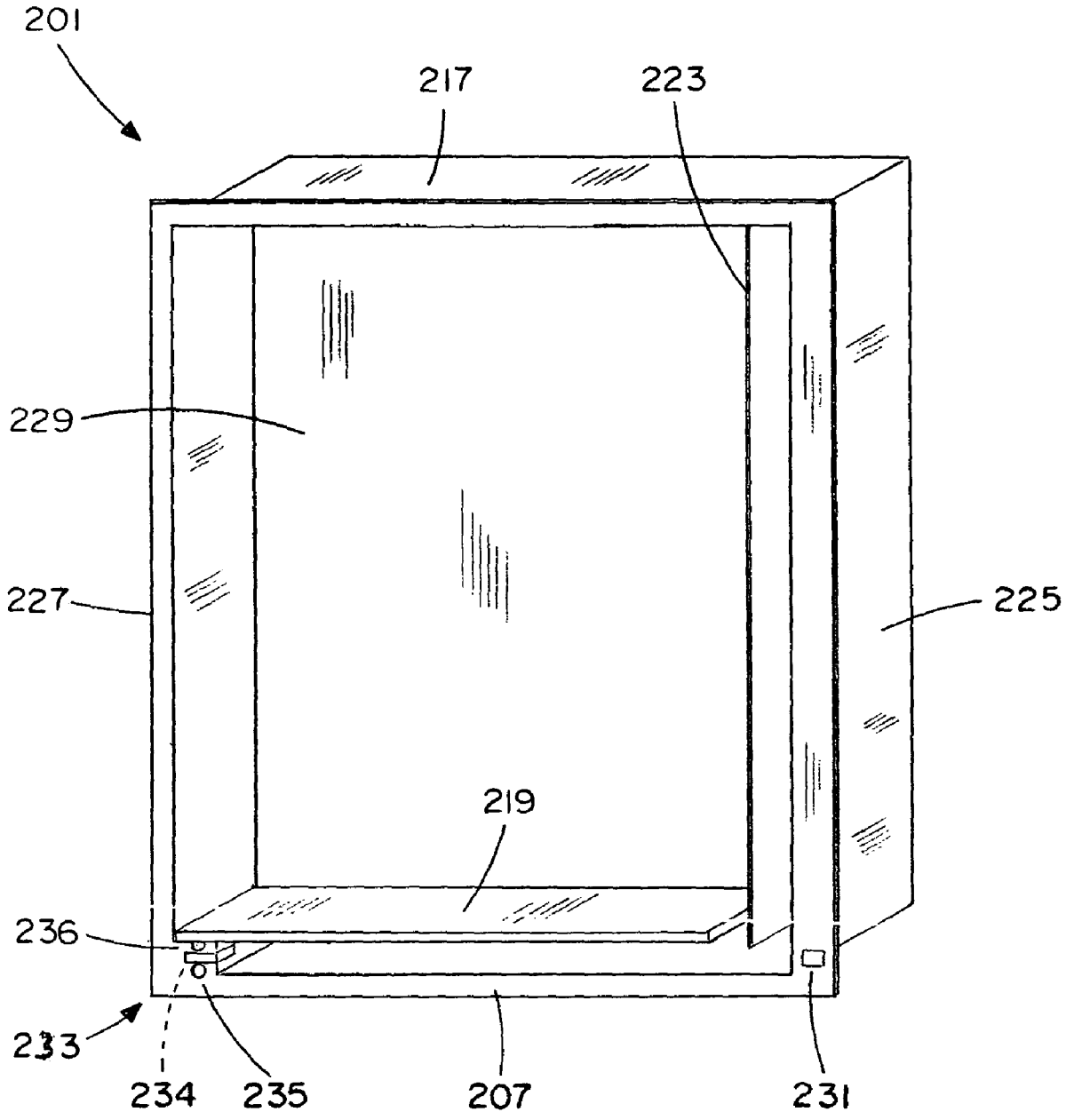
FIG. 9 is a perspective view of a tray of a cigarette package according to one embodiment of the present invention.
Figure 10:
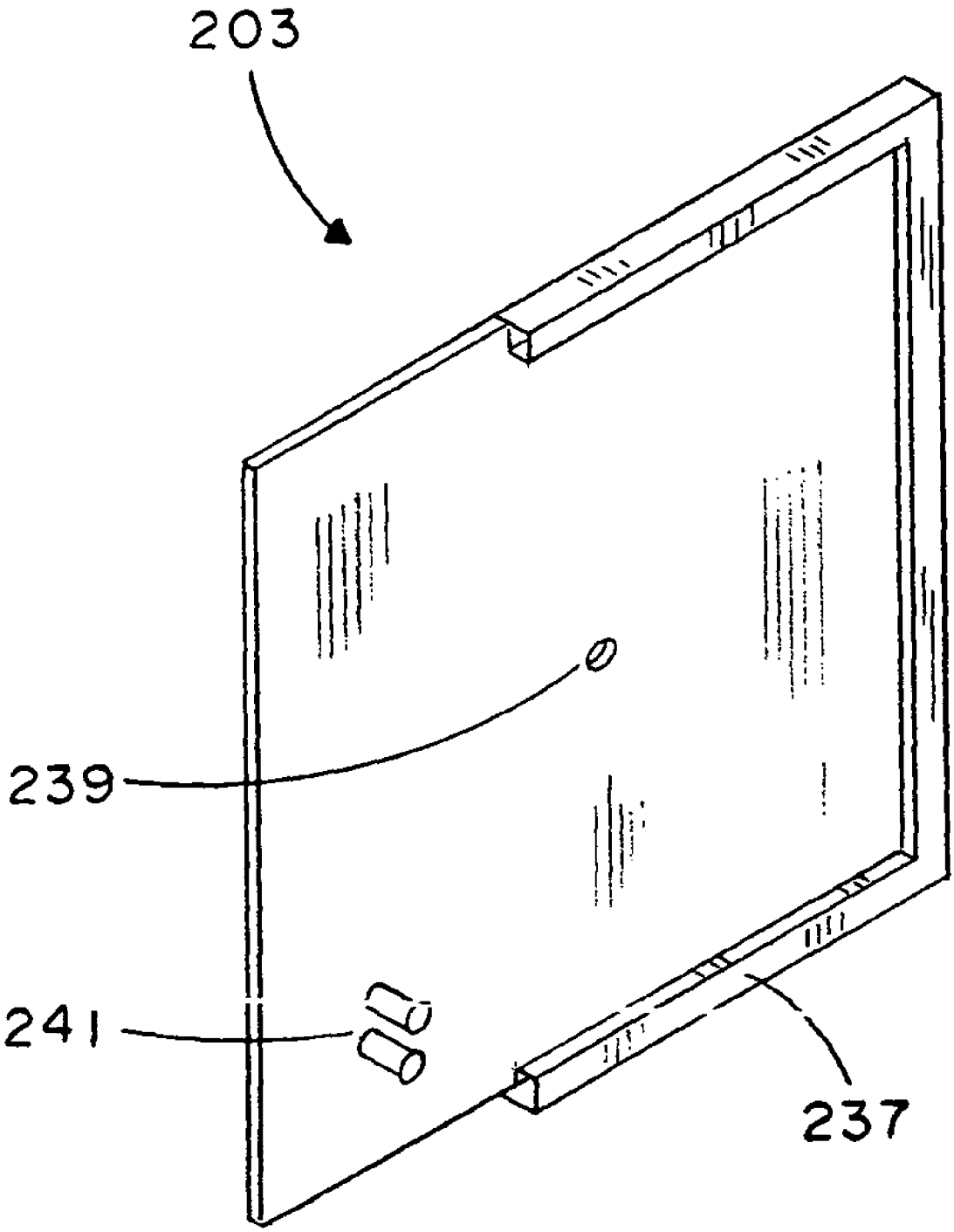
FIG. 10 is a perspective view of a cover of a cigarette package according to one embodiment of the present invention.
Figure 11:
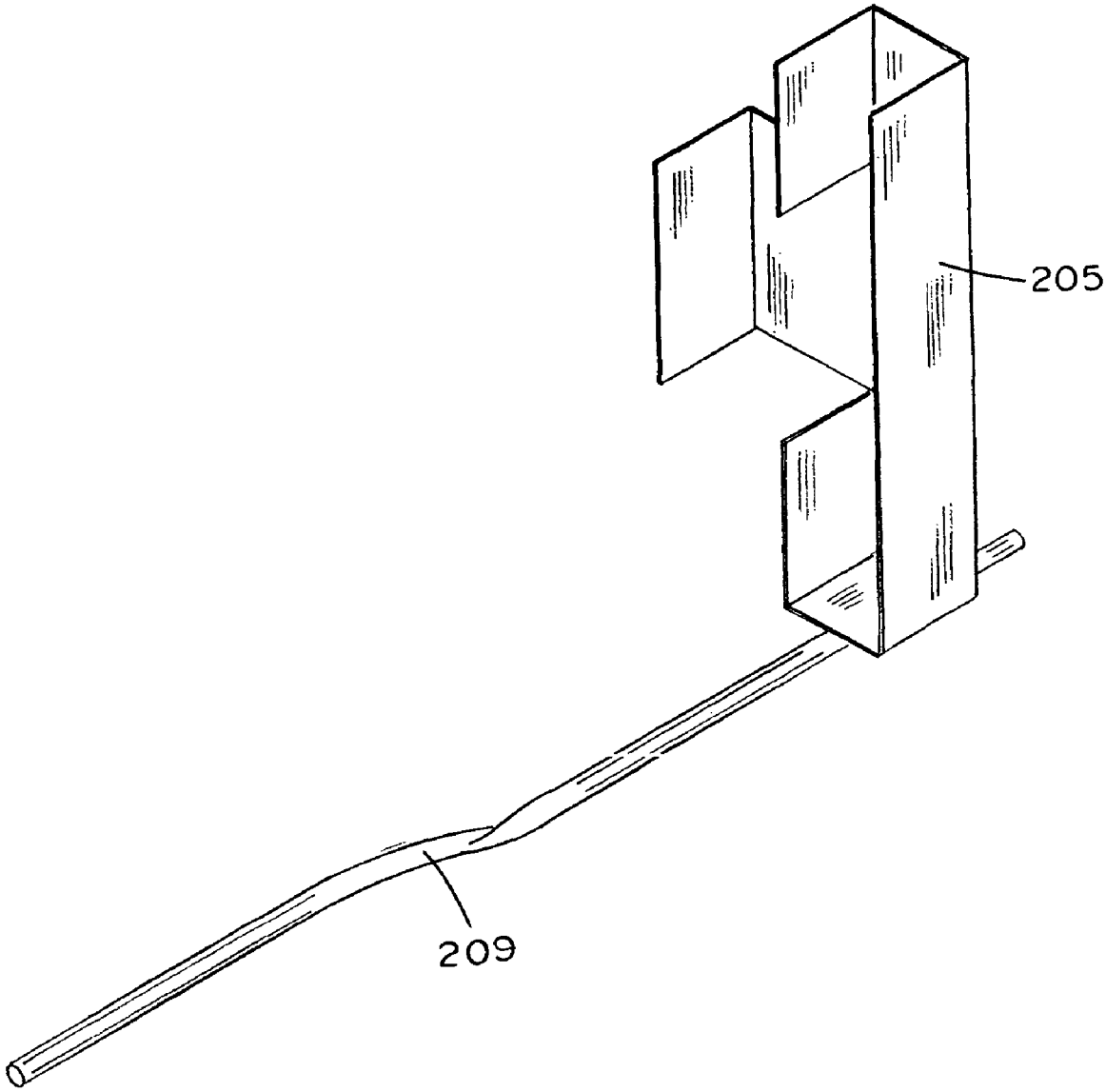
FIG. 11 is a perspective view of a cigarette holder coupled to a twist shaft according to one embodiment of the present invention.

FIGS. 7-11 illustrate a cigarette package and its various components according to another embodiment of the present invention. FIG. 7 is a top plan view of the cigarette package while FIG. 8 is a cross-sectional view of the cigarette package taken along the 8-8 line of FIG. 7. FIG. 9 is a perspective view of a tray of the cigarette package, and FIG. 10 is a perspective view of a cover of the cigarette package. FIG. 11 is a perspective view of a cigarette holder coupled to a twist shaft of the cigarette package.

In the embodiment of the cigarette package illustrated in FIGS. 7-11, the cigarette holder is coupled to the cover by a twist shaft. Coupling the cigarette holder to the cover through a twist shaft enables the cigarette holder to concertedly move from a first position substantially inside the tray to a second position substantially outside the tray as the cover moves from a closed position to an open position.

Referring now to FIG. 7, the cigarette package 200 comprises a tray 201, a cover 203 adapted to be secured to the tray 201, and a cigarette holder 205 secured to a first wall 207 of the tray. The cigarette holder 205 is coupled to the cover 203 by a twist shaft 209 disposed in the first wall 207 of the tray 201. The cover 203 in FIG. 7 is shown in the open position and the cigarette holder 205 is correspondingly in a second position substantially outside the tray 201. Coupling the cigarette holder 205 to the cover 203 by a twist shaft 209 enables the cigarette holder 205 to move from a first position substantially inside the tray 201 to a second position substantially outside the tray 201 as the cover 203 moves from a closed position to the open position.

The cigarette package 200 of FIG. 7 additionally comprises a plurality of cigarettes 211 disposed in the tray 201 with at least one cigarette 213 disposed in the cigarette holder 205. The cigarette holder 205 may be operable to hold two or less cigarettes 211. The plurality of cigarettes 211 are arranged in the tray in a first row 212, wherein a portion of each of the plurality of cigarettes 211 is placed under a cigarette blocking element 215. The cigarette blocking element 215 is secured to a second wall 217 of the tray 201, the second wall 217 being in facing opposition to the first wall 207. The cigarette blocking element 215 is operable to prevent the plurality of cigarettes 211 from falling out of the tray 201 when the cover 203 of the cigarette package 200 is in the open position. The cigarette blocking element 215 may comprise paper, metal foil, a plastic wrap or other polymeric material, and/or combinations thereof, or other materials typically used in constructing such packages.

The plurality of cigarettes 211 in FIG. 7 are supported by a raised plate 219 disposed in the tray 201 adjacent to the cigarette holder 205. The raised plate 219 may be secured to a first wall 207 of the tray 201 or the raised plate 219 may be included as a continuous part of the tray 201 formed in the initial construction of the tray 201. As shown in FIG. 7, the raised plate 219 is disposed in the tray 201 on a plane higher than the base 221 of the cigarette holder 205. This arrangement may assist cigarettes 211 with falling into the cigarette holder 205 from the raised plate 219 for subsequent dispensing.

The cigarette package of FIG. 7 further comprises a cigarette holder blocking element 223 disposed in the tray adjacent to the cigarette holder 205. The cigarette holder blocking element 223 may be secured to the back wall (not shown) wall of the tray 201 and may be parallel to the third 225 and fourth (not shown) walls of the tray 201. Cigarette holder blocking elements can be constructed from paper, metal, metal foil, plastic, and/or combinations thereof, or other materials typically used in constructing cigarette packages or components thereof. In other embodiments, cigarette holder blocking elements can be included as continuous part of a tray formed in the initial construction of the tray. In embodiments where the plurality of cigarettes 211 are disposed in a tray in a series of two or more rows, a cigarette holder blocking element can prevent cigarettes located in rows other than a predetermined row (e.g., a front row or a rear row) from entering a cigarette holder.

FIG. 8 is a cross-sectional view of the cigarette package 200 taken along the 8-8 line of FIG. 7. As in FIG. 7, the cover 203 of the cigarette package 200 is in an open position, and the cigarette holder 205 is shown in a position substantially outside the tray 201. The second position of the cigarette holder 205 can be between about 30 degrees and about 45 degrees out of plane with the cover 203 and tray 201 of the cigarette package 200 in some embodiments. In some embodiments, a cigarette holder can be adapted to be out of plane with the cover and tray in other amounts. For example, in some embodiments, the cigarette holder can be adapted to be positioned a variety of degree amounts, up to about 90 degrees out of plane with the cover and tray. In selecting an amount, factors to be considered can include, for example, allowing the cigarette holder to be in a position to facilitate removal of at least one cigarette held therein and avoiding the positioning of the cigarette holder such that a cigarette can accidentally fall out of the holder.

As the cigarette holder 205 is coupled to the cover 203 by a twist shaft 209, the cigarette holder 205 is operable to rotate from the first position substantially inside the tray 201 to the second position substantially outside the tray 201 as the cover 203 moves from a closed position to an open position. In some embodiments, the cigarette holder 205 is operable to rotate at least 30 degrees from the first position. In other embodiments, the cigarette holder 205 is operable to rotate up to about 45 degrees. In a further embodiment, the cigarette holder is operable to rotate from about 30 degrees to about 45 degrees.

In FIG. 8, the cover 203 of the cigarette package 200 is slidingly coupled to the tray 201. As a result, the cigarette holder 205 rotates from the first position substantially inside the tray 201 to the second position substantially outside the tray 201 as the cover 203 slides from a closed position to an open position. The movement of the cigarette holder 205 from the first position to the second position is reversible. The cigarette holder 205, for example, is operable to rotate from the second position substantially outside the tray 201 to the first position substantially inside the tray 201 as the cover 203 slides from an open position to a closed position.

As illustrated in FIG. 8, the cigarette holder blocking element 223 is disposed in the tray 201 to prevent cigarettes 211 in a row and/or rows behind the first row 212 of cigarettes 211 from entering the cigarette holder 205. The raised plate 219 supporting the first row 212 and any additional rows of cigarettes 211 behind the first row 212 is positioned in the tray 201 above the base 221 of the cigarette holder 205. This arrangement can assist cigarettes 211 in the first row with falling into the cigarette holder 205.

The tray 201 of the cigarette package 200 illustrated in FIG. 9 comprises first 207, second 217, third 225, and fourth 227 walls and a back wall 229. The raised plate 219, in some embodiments, may be secured to the first wall 207 by any means known to one of ordinary skill in the art, including convection heating, induction sealing, adhesive, and/or other techniques. In other embodiments, a raised plate can be included as a continuous part of a tray formed in the initial construction of the tray. The cigarette holder blocking element 223 is secured to the back wall 229 in the embodiment shown. Cigarette holder blocking elements can be secured to the back wall by any means known to those of skill in the art, including, without limitation, convection heating, induction sealing, adhesive, and/or other techniques. In other embodiments, the cigarette holder blocking element can be included as a continuous part of a tray formed in the initial construction of the tray.

As shown in FIG. 9, the first 207 and third 225 walls of the tray 201 comprise structures operable for receiving the twist shaft 209. In the embodiment shown, the third wall 225 comprises a mounting hole 231 operable for receiving one end of the twist shaft 209 while the first wall 207 comprises a shaft lock 233 operable for receiving the remaining end of the twist shaft 209. In the embodiment shown in FIG. 9, the shaft lock 233 comprises a side-channel 234 for receiving the twist shaft 209 and a plurality of holes 235, 236 in which a latch (not shown) may be inserted. The latch holds the twist shaft in place without impairing the rotational freedom of the twist shaft.

The cover 203 of the cigarette package 200 illustrated in FIG. 10 is adapted to be slidably coupled to the tray 201. The cover 203 comprises a partial rim 237 having a structure adapted to be slidably secured to the tray 201 and a raised stop 239, which may prevent the cover 203 from sliding completely off the tray 201. In the embodiment shown, the partial rim 237 displays a "J" structure adapted to secure the cover 203 to a rim of the tray 201. The "J" structure may slidably interface with a flat rim of the tray 201 or may slidably interface with an "L" shaped rim of the tray 201. In other embodiments, the cover may be adapted to be secured to the tray by other means known to one of skill in the art. In some embodiments, the partial rim and/or tray may comprise one or a plurality of stops operable to prevent the cover from sliding off the tray if such a feature is desirable.

The cover 203 in the embodiment shown further comprises a slot 241 for receiving the twist shaft 209. When the cover 203 is secured to the tray 201, the twist shaft 209 is inserted into the slot 241.

The twist shaft 209, in one embodiment of the present invention, can have a effective twist angle of at least 30 degrees. In another embodiment, the twist shaft 209 can have an effective twist angle of up to about 45 degrees. In a further embodiment, the twist shaft 209 has an effective twist angle from about 30 degrees up to about 45 degrees. As the cover 203 slides from the closed position to the open position or from the open position to the closed position, the slot 241 slides along the twist shaft 209 causing the twist shaft 209 to rotate an amount corresponding to its effective twist angle. In some embodiments, the twist shaft can be constructed of plastic. In other embodiments, the twist shaft can be constructed of metal or other suitable materials.

The cigarette holder 205 may be secured to the twist shaft 209 as shown in FIG. 11. A cigarette holder can be secured to a twist shaft by one or more adhesives or by any other suitable means. With the cigarette holder 205 secured to the twist shaft 209, rotation of the twist shaft 209 is effectuated by sliding the cover 203 and can result in rotation of the cigarette holder 205. Sliding the cover 203 from a closed position to an open position, for example, can cause the twist shaft 209 rotate in a clockwise manner in an amount corresponding to the twist shaft's effective twist angle. The rotation of the twist shaft 209 results in a commensurate clockwise rotation of the cigarette holder 205 from the first position substantially inside the tray 201 to the second position substantially outside the tray 201. Similarly, sliding the cover 203 from the open position to the closed position can cause the twist shaft to rotate in a counter-clockwise manner an amount corresponding to the twist shaft's effective twist angle. This rotation of the twist shaft 209 results in a commensurate counter-clockwise rotation of the cigarette holder 205 from the second position substantially outside the tray 201 to the first position substantially inside the tray 201.

In other embodiments, a twist shaft and cigarette holder can rotate in a counter-clockwise manner as a cover slides and/or otherwise moves from a closed position to an open position enabling the cigarette holder to rotate from a first position substantially inside a tray to a second position substantially outside the tray. Moreover, in such embodiments, the twist shaft and cigarette holder can rotate in a clockwise manner as the cover slides and/or otherwise moves from the open position to the closed position enabling the cigarette holder to rotate from the second position substantially outside the tray to the first position substantially inside the tray.

The embodiment of the a cigarette package illustrated in FIGS. 7-11 can be operated by a consumer as follows. In one embodiment, when purchased, a consumer may remove any overwrapping from the cigarette package 200 and grip the cigarette package 200 in one hand. The consumer may use a finger, such as the thumb, to slide the cover 203 of the cigarette package 200 into the open position. The finger used to slide the cover 203 may be on the hand gripping the package 200 or on a hand not gripping the package 200. As the cover 203 slides into the open position, the cigarette holder 205 and at least one cigarette 213 held therein can rotate from a first position substantially inside the tray to a second position substantially outside the tray. The at least one cigarette 213 in the cigarette holder 205 is in position to be removed by the consumer. Depending on consumer preference, the consumer can remove the at least one cigarette 213 from the cigarette holder 205 with his mouth, thereby avoiding contaminating the cigarette 213 with unclean hands, or by his hand.

After removing the cigarette 213 from the cigarette holder 205, the consumer slide the cover 203 from the open position to the closed position. As the cover 203 slides from the open position to the closed position, the cigarette holder 205 rotates from the second position substantially outside the tray to the first position substantially inside the tray such that the cigarette holder 205 is underneath the cover 203 when the cover 203 is in the closed position.

After the empty cigarette holder 205 is returned to the first position substantially inside the tray, another cigarette 211 previously disposed in the tray 201 can move into the cigarette holder 205 for subsequent dispensing. A consumer may gently shake the cigarette package 200 in some embodiments to effectuate movement of cigarettes 211 disposed in the tray such that one cigarette may travel off the raised plate 219 and into the cigarette holder 205.

Figure 14:
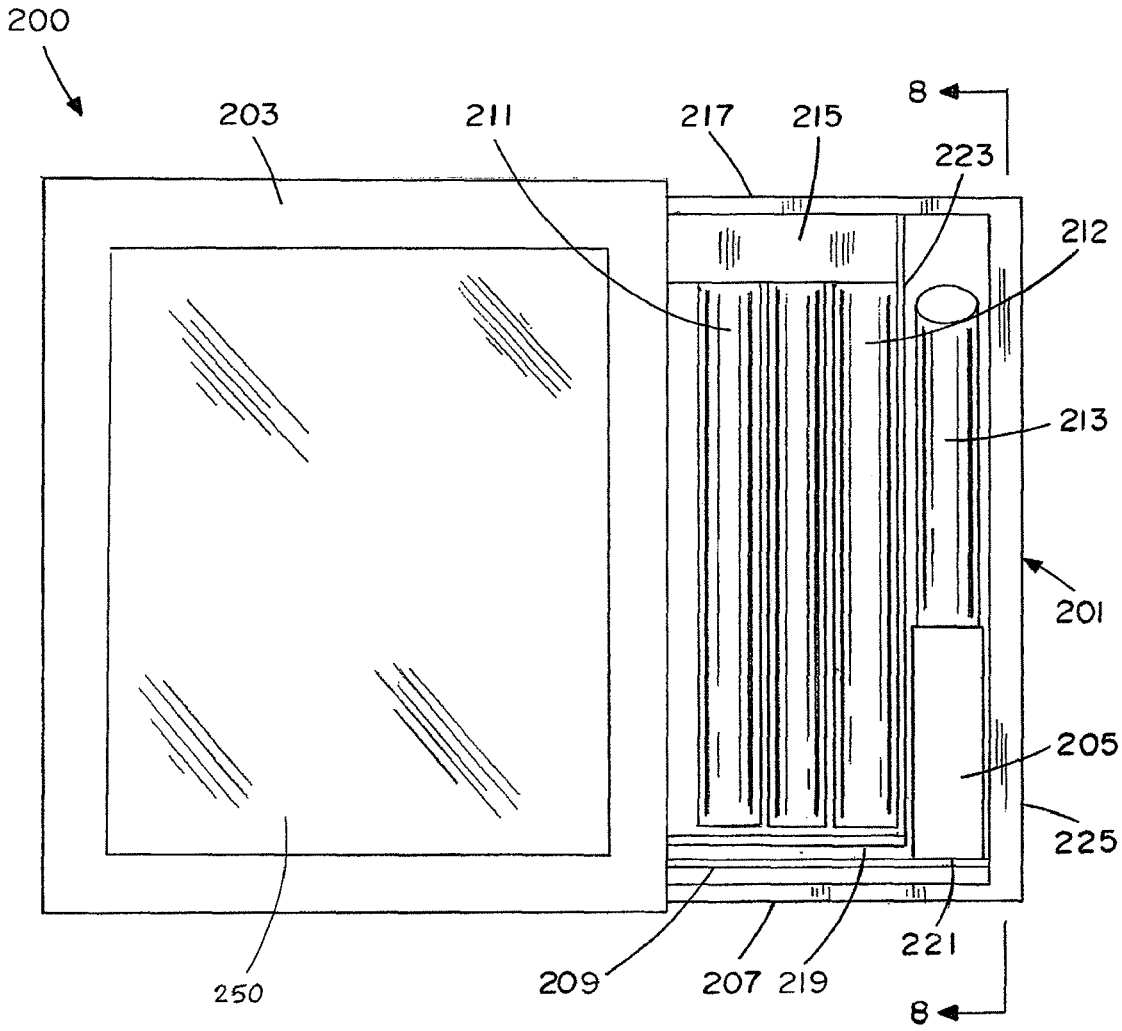
FIG. 14 is a top plan view of a cigarette package according to one embodiment of the present invention.

In some embodiments, a cover can comprise a window located above a cigarette holder so that a consumer may determine whether a cigarette is in the cigarette holder for dispensing before sliding the cover to the open position. FIG. 14 illustrates a cover 203 comprising a window 250. When the cover 203 is in the closed position, the window 250 can be at least partially positioned above the cigarette holder 205.

Figure 12:
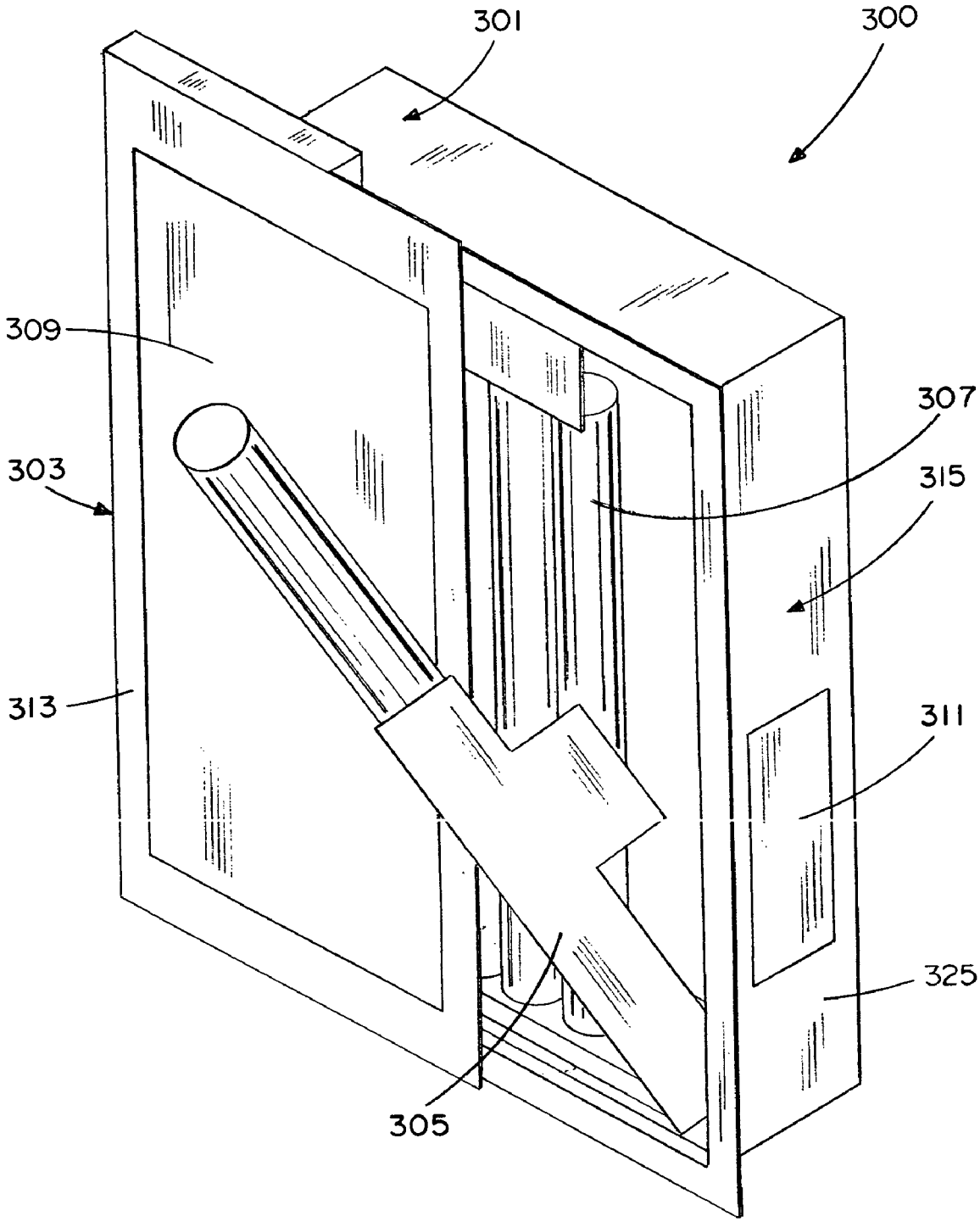
FIG. 12 is a perspective view of a cigarette package according to one embodiment of the present invention.

As illustrated in FIG. 12, cigarette packages of the present invention advantageously provide a number of surfaces for product information, advertisements, coupons, and/or combinations thereof. The cigarette package 300 shown in FIG. 12 comprises the same general features of as the cigarette packages illustrated in FIGS. 1-11. In the embodiment shown in FIG. 12, the cigarette package 300, which includes a tray 301, a cover 303, a cigarette holder 305, and a plurality of cigarettes 307, further comprises a plurality of labels 309, 311 affixed to the cover 303 and tray 301. The labels can comprise product information, advertisements, and/or coupons. The cover 303 of the cigarette package 300 comprises a top face and a bottom face. Only the top face 313 of the cover 303 is visible in FIG. 12. The tray 301 comprises four side walls. The tray further comprises a back wall. Each of the walls comprises an inner and outer surface with the outer surface 325 of side wall 315 being displayed in FIG. 12. In general, product information, advertisements, coupons, and other information can be provided on any of these surfaces.

A first label 309 can be affixed to the top face 313 of the cover 303, and a second label 311 can be affixed to the outer surface 325 of side wall 315. Although not shown, a third label can be affixed to the outer face of back wall and a fourth label can be affixed to the outer surface of any of the remaining side walls. Moreover, labels comprising coupons or other product advertisements can be placed on the inner surface (not shown) of the back wall such that when the package 300 is empty of cigarettes, a consumer can retrieve the label.

In some embodiments of the present invention, any number of labels can be affixed to any of the surfaces of the cover and/or tray of the cigarette package.

A wide variety of product information can be printed on the labels including, for example, product name, brand name, manufacturer name, manufacturer address, trademarks, logos, product descriptions, government information, etc. Such information can be printed on the label, and the label may be affixed to the faces of the cover 303 and walls of the tray 301 using techniques known to those of ordinary skill in the art.

In some embodiments, the covers and trays of cigarette packages of the present invention can be constructed from plastic and/or other polymeric materials or metal. Examples of suitable materials for constructing cigarette packages of the present invention include metal (e.g., tin, steel, aluminum, etc.) and plastic (e.g. high density polypropylene, polyethylene, polyurethane, and other molded plastic materials). The use of such materials may result in a cigarette package that is generally rigid and "crush proof." In some embodiments, the cigarette package may be constructed from a single material. For example, in one embodiment where the cigarette package is constructed of plastic, the tray, cover, and/or cigarette holder may be individually molded by techniques known to those of ordinary skill in the art, such as injection molding. The embodiments of cigarette packages shown in FIGS. 1-12 can be constructed from plastic. In embodiments where the cigarette package is constructed from metal, metal sheets may be stamped and formed to provide the tray and the cover. The embodiments of cigarette packages shown in FIGS. 1-12 can be constructed from metal.

In other embodiments, cigarette packages of the present invention can be constructed from both metal and plastic (e.g., tin, steel, aluminum, etc.) and plastic (e.g., high density polypropylene, polyethylene, and other molded plastic materials). In one embodiment, for example, the cover of the cigarette package may be constructed of plastic while the tray is constructed of metal. In another embodiment, the cover of the cigarette package may be constructed of metal and the tray is constructed of plastic.

In embodiments using plastic and/or other polymeric materials, the product information, advertisements, and/or coupons may be printed on labels, and the labels are affixed to the desired surfaces of the cover and/or tray. In other embodiments, however, the product information, advertisements, and/or coupons may be preprinted directly on the surfaces of the cover and tray.

In embodiments of cigarette packages utilizing metal covers and trays, the product information, advertisements, and/or coupons may be preprinted on the metal covers and trays prior to assembly into cigarette packages. Product information, advertisements, and/or coupons may be printed directly on surfaces of the covers and trays using techniques known to those of ordinary skill in the art. Labels may also be affixed to surface of metal covers and metal trays. Product information, advertisements, and/or coupons may also be embossed on metal covers and metal trays using techniques known to one of ordinary skill in the art. The metal covers and trays may be embossed to provide textured areas to the covers such as a tractive region for gripping the cover. In addition to that described above, product information, advertisements, and/or coupons may be provided on any inner or outer surface of the cover or tray. This information may be preprinted on the surface itself or may be preprinted on a label and affixed to the surface.

In other embodiments, cigarette packages of the present invention may be overwrapped with an outer wrapping material using techniques known to those of ordinary skill in the art. The outer wrapping material may comprise cellophane, polypropylene film, the metallized material described in European application Publication No. 454,003, the overwrapping materials described in U.S. Pat. No. 4,807,745 to Langley et al. and U.S. Pat. No. 4,947,994 to Newsome, or other known materials. The overwrapping material for each cigarette package preferably includes a tear tape, which is provided using known techniques. The tear tape may be positioned so as to circumscribe the package in a number of locations on the cigarette package in order to facilitate removal of the overwrapping material by a consumer.

In other embodiments of the present invention, cigarette packages may additionally comprise a loose sheet of printed information, which is sometimes referred to as a "chit." Chits may be placed in the tray of a cigarette package of the present invention. In some embodiments wherein a plurality of cigarettes are disposed in the tray of the cigarette package, a chit may be placed on top of the plurality of cigarettes such that a consumer sees the chit upon opening the cover of the cigarette package. Since the chit is typically loose within the cigarette package, (i.e. not affixed to the cover or tray) a consumer may easily discard the chit. Examples of information that may be printed on chits include product name, brand name, manufacturer name, manufacturer address, trademarks, logos, product design, etc.

As noted earlier, cigarette packages of the present invention may further comprise a plurality of cigarettes. While cigarettes may have any number of dimensions, typical cigarettes are filtered cigarettes having a total length between about eighty and about one hundred five millimeters (80-105 mm). In one embodiment, cigarettes used in the present invention can have lengths between about eighty-three and about eighty-five millimeters (83-85 mm). In a further embodiment, cigarettes used in a cigarette package of the present invention can have a length of about eighty-four millimeters (84 mm), with a tobacco rod length of about fifty-seven (57 mm) and a filter element length of about twenty-seven (27 mm). In other embodiments, cigarettes for packages of the present invention can have lengths between about ninety-eight (98 mm) and about one hundred one millimeters (101 mm). Typical circumferences of cigarettes are between about twenty-one millimeters (21 mm) to about twenty-seven millimeters (27 mm). The dimensions of cigarette packages of the present invention may be selected based on the number of cigarettes and the dimensions of the cigarettes that they are to carry. Therefore, cigarette packages of the present invention can be designed to hold any number of different cigarette sizes and any number of cigarettes.

Embodiments of the present invention also relate to methods for dispensing cigarettes from a package. In some embodiments, methods of the present invention comprise providing a cigarette package comprising a tray, a cover slidably coupled to the tray, a cigarette holder, at least one cigarette positioned in the holder, wherein the cigarette holder is adapted to move between a first position substantially inside the tray and a second position substantially outside the tray as the cover slides; and sliding the cover from a closed position to an open position so as to move the cigarette holder from the first position to the second position. In some embodiments, a consumer may use one hand to slide the cover from the closed position to the open position.

In some embodiments, the cigarette holder and the at least one cigarette positioned therein rotate from the first position to the second position. In some embodiments, the cigarette holder and the at least one cigarette positioned therein rotate at least about 30 degrees from the first position. In some embodiments, the cigarette holder and the at least one cigarette positioned therein rotate up to about 45 degrees. In some embodiments, the cigarette holder and at least one cigarette positioned therein rotate between about 30 degrees and about 45 degrees.

A method for dispensing cigarettes according to an embodiment of the present invention, may further comprise removing the at least one cigarette from the cigarette holder. In some embodiments, removing the at least one cigarette may comprise a consumer using his or her mouth to remove the at least one cigarette from the cigarette holder. In such embodiments, the consumer does not have to handle the at least one cigarette with his or her hands and may obtain a cigarette with the use of only one hand. In another embodiment, removing the at least one cigarette may comprise a consumer using his or her fingers to remove the at least one cigarette from the cigarette holder.

Methods for dispensing cigarettes from a cigarette package according to embodiments of the present invention can further comprise sliding the cover of the cigarette package from the open position to the closed position. In some embodiments, a consumer may use one hand to slide the cover of the cigarette package from the open position to the closed position. The cigarette holder can move from the second position substantially outside the tray to the first position substantially inside the tray as the cover slides from the open position to the closed position.

In some embodiments, the cigarette holder rotates from the second position to the first position as the cover of the cigarette package slides from the open position to the closed position. In some embodiment, the cigarette holder rotates at least 30 degrees from the second position. In some embodiments, the cigarette holder rotates up to about 45 degrees from the second position. In some embodiments, the cigarette holder can rotate between about 30 degrees and about 45 degrees from the second position.

A method of dispensing cigarettes from a cigarette package according to an embodiment of the present invention can further comprise positioning a second cigarette in the cigarette holder. With the empty cigarette holder being in a position substantially inside the tray, it may receive a second cigarette, the second cigarette being previously positioned in the tray. In some embodiments, the second cigarette can be disposed on a raised plate, wherein the raised plate is positioned in the tray on a plane higher that the base of the cigarette holder. A consumer can gently shake the cigarette package to cause the second cigarette to fall from the raised plate into the cigarette holder. In some embodiments, the cover of the cigarette package comprises a window which may allow a consumer to view the cigarette holder disposed in the tray. The consumer can determine if the cigarette holder contains a cigarette for dispensing by viewing the cigarette holder through the window. When the cigarette holder contains the second cigarette, the method of dispensing cigarettes from the cigarette package can be repeated.

With respect to the descriptions set forth above, optimum dimensional relationships for the parts of the invention (to include variations in size, materials, shape, form, function and manner of operation, assembly, and use) are deemed readily apparent and obvious to those of ordinary skill in the art, and all equivalent relationships to those illustrated in the drawings and described in the specification are intended to be encompassed herein.

The foregoing is considered illustrative only of the principles of the invention. Since numerous modifications and changes will readily occur to those of ordinary skill in the art, the foregoing is not intended to limit the invention to the exact construction and operation shown and described, and all suitable modifications and equivalents falling within the scope of the appended claims are deemed within the present inventive concept.

The features of the present invention, together with the other objects of the invention and along with the various features of novelty which characterize the invention, are pointed out with particularity in the following claims.

That which is claimed is:

1. A cigarette package comprising:

a tray having a first wall and a second wall, wherein the second wall is in facing opposition to the first wall;

a cover coupled to the tray;

a cigarette holder secured to the tray at the first wall and adapted to move between a first position substantially inside the tray and a second position substantially outside the tray wherein the cigarette holder is positioned such that the cigarette holder only spans a portion of the width of a cavity defined by the tray; the cigarette holder further comprising a blank, wherein the blank is folded to form the cigarette holder and wherein the cigarette holder is hingedly secured to the first wall via the blank; and a cigarette blocking element secured to the second wall, extending from the second wall in the direction of the first wall such that the cigarette blocking element partially covers the cavity defined by the tray.

2. The cigarette package of claim 1, wherein the cigarette holder is hingedly secured to a first wall of the tray.

3. The cigarette package of claim 1, wherein the cigarette holder is operable to dispense at least one cigarette.

4. The cigarette package of claim 1, wherein the cigarette holder is operable to hold two or less cigarettes.

5. The cigarette package of claim 1, wherein the cigarette holder rotates from the first position to the second position.

6. The cigarette package of claim 5, wherein the cigarette holder is operable to rotate at least about 30 degrees from the first position.

7. The cigarette holder of claim 5, wherein the cigarette holder is operable to rotate up to about 45 degrees from the first position.

8. The cigarette package of claim 1, further comprising a raised plate disposed in the tray adjacent to the cigarette holder.

9. The cigarette package of claim 1, wherein the cover comprises a window.

10. The cigarette package of claim 1, further comprising a plurality of cigarettes disposed in the tray.

11. The cigarette package of claim 10, wherein at least one of the plurality of cigarettes is disposed in the cigarette holder.

12. The cigarette package of claim 10, wherein the plurality of cigarettes comprises at least ten cigarettes.

13. The cigarette package of claim 10, wherein the plurality of cigarettes comprises twenty cigarettes.

14. The cigarette package of claim 1, wherein the cover is adapted to move between a closed position and an open position.

15. The cigarette package of claim 14, wherein the cigarette holder is coupled to the cover.

16. The cigarette package of claim 15, wherein the cigarette holder moves between the first position and the second position as the cover moves between the closed position and the open position.

17. The cigarette package of claim 15, wherein the cigarette holder rotates from the first position to the second position as the cover moves from the closed position to the open position.

18. The cigarette package of claim 15, wherein the cigarette holder is coupled to the cover by a twist shaft.

19. The cigarette package of claim 1, wherein the cover is slidably coupled to the tray, such that the cover slides between a closed position and an open position.

20. The cigarette package of claim 19, wherein the cigarette holder is coupled to the cover.

21. The cigarette package of claim 20, wherein the cigarette holder moves between the first position and the second position as the cover slides between the closed position and the open position.

22. The cigarette package of claim 20, wherein the cigarette holder rotates from the first position to the second position as the cover slides from the closed position to the open position.

23. The cigarette package of claim 22, wherein the cigarette holder is coupled to the cover by a twist shaft.

24. A cigarette package comprising:

a tray having a first wall and a second wall, wherein the second wall is in facing opposition to the first wall;

a cover adapted to slide on the tray between a closed position and an open position;

a cigarette holder coupled to the first wall of the tray and adapted to move between a first position and a second position as the cover slides on the tray, wherein the cigarette holder is operable to dispense only a portion of a plurality of cigarettes disposed in the tray and wherein the cigarette holder is coupled to the cover by a twist shaft such that the cigarette holder rotates from the first position to the second position as the cover slides from the closed position to the open position; and a cigarette blocking element secured to the second wall, extending from the second wall in the direction of the first wall such that the cigarette blocking element partially covers a cavity defined by the tray.

25. The cigarette package of claim 24, wherein the cigarette holder is operable to dispense at least one cigarette.

26. The cigarette package of claim 24, wherein the cigarette holder is operable to hold two or less cigarettes.

27. The cigarette package of claim 24, wherein the cigarette holder is operable to rotate at least about 30 degrees from the first position.

28. The cigarette package of claim 24, wherein the cigarette holder is operable to rotate up to about 45 degrees from the first position.

29. The cigarette package of claim 24, further comprising a raised plate disposed in the tray adjacent to the cigarette holder.

30. The cigarette package of claim 24, wherein the cover comprises a window.

31. The cigarette package of claim 24, further comprising a plurality of cigarettes disposed in the tray.

32. The cigarette package of claim 31, wherein at least one of the plurality of cigarettes is disposed in the cigarette holder.

33. The cigarette package of claim 31, wherein the plurality of cigarettes comprises at least ten cigarettes.

34. The cigarette package of claim 31, wherein the plurality of cigarettes comprises twenty cigarettes.

35. The cigarette package of claim 10, wherein the cigarette blocking element covers a portion of each of the plurality of cigarettes disposed in the tray.

36. The cigarette package of claim 31, wherein the cigarette blocking element covers a portion of each of the plurality of cigarettes disposed in the tray.

* * * * *